US010515772B2

(12) United States Patent
Liu et al.

(10) Patent No.: US 10,515,772 B2
(45) Date of Patent: Dec. 24, 2019

(54) DISCONNECTOR AND MANUFACTURING METHOD

(71) Applicant: ABB Schweiz AG, Baden (CH)

(72) Inventors: Xuan Liu, Beijing (CN); Rui Chen, Beijing (CN); Jiaquan Yan, Guangzhou (CN); Zhangang Lv, Beijing (CN)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/911,855

(22) Filed: Mar. 5, 2018

(65) Prior Publication Data

US 2018/0197704 A1 Jul. 12, 2018

Related U.S. Application Data

(63) Continuation of application No. PCT/CN2016/093575, filed on Aug. 5, 2016.

(51) Int. Cl.

*H01H 11/04* (2006.01)
*H01H 31/02* (2006.01)
*H01H 31/36* (2006.01)

(52) U.S. Cl.

CPC ..... *H01H 31/36* (2013.01); *H01H 11/04* (2013.01); *H01H 31/026* (2013.01); *H01H 2201/024* (2013.01)

(58) Field of Classification Search

CPC .. H01H 3/46; H01H 9/24; H01H 9/26; H01H 31/36; H01H 31/026; H01H 31/02; H01H 31/34; H01H 11/04

(Continued)

(56) References Cited

U.S. PATENT DOCUMENTS 2,748,212 A * 5/1956 Butz ..... H01H 31/36 200/48 R
2,781,426 A * 2/1957 Lardelli ..... C09D 161/24 200/250

(Continued)

FOREIGN PATENT DOCUMENTS

CN 1061488 A 5/1992
CN 1658350 A 8/2005

(Continued)

OTHER PUBLICATIONS

Translation CN203491172 (original document published Mar. 19, 2014) (Year: 2014).*

(Continued)

*Primary Examiner* — Edwin A. Leon
*Assistant Examiner* — William A Bolton
(74) *Attorney, Agent, or Firm* — Taft Stettinius & Hollister LLP; J. Bruce Shelkopf

(57) ABSTRACT

A disconnector and a method for manufacturing the disconnector are disclosed in the present application. The disconnector includes conductive arms pivotally coupled with each other, and finger contacts. The finger contacts have two opposite ends and an elastic portion between the two opposite ends, each of the finger contacts being fixed to the respective conductive arm by fasteners at the two opposite ends such that the elastic portion presses against the conductive arm. In response to the conductive arms being pivoted toward each other and clamping an electrical contact hanged at a bus-bar above the disconnector, the conductive arms are electrically coupled with the electrical contact via the respective finger contacts. A method of manufacturing a disconnector is also disclosed.

15 Claims, 4 Drawing Sheets

(58) Field of Classification Search
USPC ..... 200/48 V, 48 R, 48 A, 48 KB, 48 CB; 218/12, 67, 100, 80
See application file for complete search history.

(56) References Cited

U.S. PATENT DOCUMENTS

| | | | | | |
|---|---|---|---|---|---|
| 3,350,520 | A | * | 10/1967 | Perry | H01H 31/36 174/71 R |
| 4,481,387 | A | * | 11/1984 | Worrix | H01H 31/28 200/282 |
| 4,504,708 | A | * | 3/1985 | Hartig | H01H 1/023 200/337 |
| 2006/0214754 | A1 | | 9/2006 | Wang | |

FOREIGN PATENT DOCUMENTS

| | | | | | |
|---|---|---|---|---|---|
| CN | 201302942 | Y | | 9/2009 | |
| CN | 101882527 | A | | 11/2010 | |
| CN | 203491172 | U | * | 3/2014 | H01H 31/34 |
| DE | 1490559 | A1 | | 7/1969 | |
| DE | 3237670 | A1 | | 12/1983 | |
| DE | 3235379 | A1 | | 3/1984 | |
| FR | 70404 | E | | 5/1959 | |

OTHER PUBLICATIONS

Chinese Office Action, Chinese Patent Application No. 201680042054.1, dated Dec. 17, 2018, 6 pages including English Translation.
Chinese Search Report, Chinese Patent Application No. 201680042054.1, dated Dec. 17, 2018, 5 pages including English Translation.
State Intellectual Property Office of the P.R. China, International Search Report & Written Opinion in corresponding Application No. PCT/CN2016/093575, dated Apr. 27, 2017, 12 pp.

* cited by examiner

DISCONNECTOR AND MANUFACTURING METHOD

TECHNOLOGY

Example embodiments disclosed herein generally relate to a disconnector, and more specifically, to a disconnector used in power transmission and distribution grid and a method of manufacturing the disconnector.

BACKGROUND

Disconnectors are widely used in power transmission and distribution grid where current as high as several thousand amps are conducted. The disconnectors need to endure high current as well as heat generated by such a high current. Therefore, qualities regarding electrical conductance as well as the thermal dissipation are vital in the industry. To connect a component such as a transformer to the power grid, a disconnector requires at least one contact to form such a connection to a bus-bar of the power grid. The design of the contact is thus vital because it directly affects the qualities mentioned above and cost effectiveness.

Conventional disconnectors provide their contacts with acceptable mechanical, electrical and thermal performances are available in a high price, and thus there is a need in the art for a high performance disconnector with acceptable manufacturing and assembly costs.

SUMMARY

Example embodiments disclosed herein propose a disconnector providing satisfying contact performances while the manufacturing cost is relatively low.

In one aspect, example embodiments disclosed herein provide a disconnector. The disconnector includes conductive arms pivotally coupled with each other, and finger contacts. The finger contacts have two opposite ends and an elastic portion between the two opposite ends, each of the finger contacts being fixed to the respective conductive arm by fasteners at the two opposite ends such that the elastic portion presses against the conductive arm. In response to the conductive arms being pivoted toward each other and clamping an electrical contact hanged at a bus-bar above the disconnector, the conductive arms are electrically coupled with the electrical contact via the respective finger contacts.

In another aspect, example embodiments disclosed herein provide a method of manufacturing a disconnector. The method includes providing conductive arms, fixing a finger contact to the respective conductive arms for each of the conductive arms, and pivotally coupling the conductive arms with each other. The finger contact has two opposite ends and an elastic portion between the two opposite ends is fixed to the respective conductive arm by fasteners at the two opposite ends, such that the elastic portion presses against the conductive arm. In response to the conductive arms being pivoted toward each other and clamping an electrical contact hanged at a bus-bar above the disconnector, the conductive arms are electrically coupled with the electrical contact via the respective finger contacts.

Through the following description, it would be appreciated that the disconnector produced according to the present disclosure exhibits outstanding contact performances (mechanical, electrical and thermal performances) while the material cost as well as manufacturing and assembly costs are relatively low. As a result, such a disconnector has a potential to replace the current disconnectors or the contacts of the current disconnectors in power grid.

DESCRIPTION OF DRAWINGS

Through the following detailed descriptions with reference to the accompanying drawings, the above and other objectives, features and advantages of the example embodiments disclosed herein will become more comprehensible. In the drawings, several example embodiments disclosed herein will be illustrated in an example and in a non-limiting manner, wherein.

Throughout the drawings, the same or corresponding reference symbols refer to the same or corresponding parts.

DESCRIPTION OF EXAMPLE EMBODIMENTS

Figure 1:
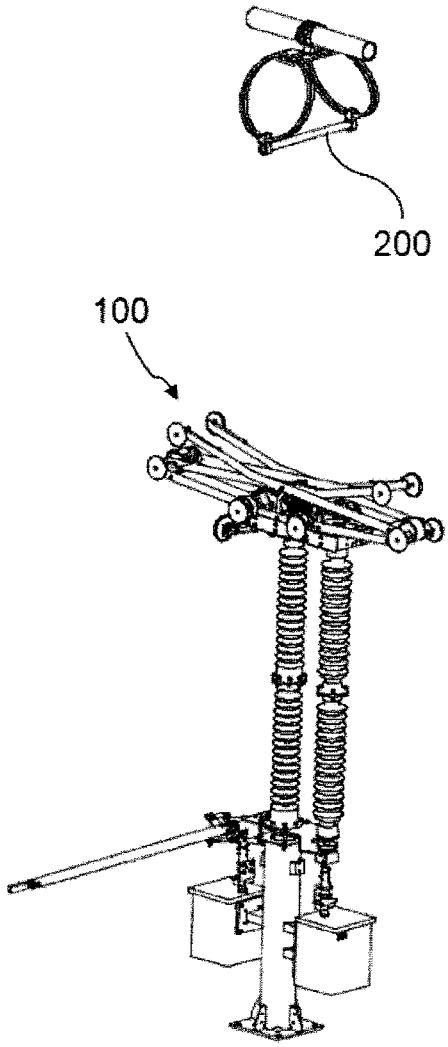
FIG. 1 illustrates an environment in which a disconnector is used to form an electrical connection with a power bus-bar in accordance with an example embodiment.

The subject matter described herein will now be discussed with reference to several example embodiments. These embodiments are discussed only for the purpose of enabling those skilled persons in the art to better understand and thus implement the subject matter described herein, rather than suggesting any limitations on the scope of the subject matter.

The term "includes" and its variants are to be read as open terms that mean "includes, but is not limited to." The term "or" is to be read as "and/or" unless the context clearly indicates otherwise. The term "based on" is to be read as "based at least in part on." The term "one embodiment" and "an embodiment" are to be read as "at least one embodiment." The term "another embodiment" is to be read as "at least one other embodiment." Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings. In the description below, like reference numerals and labels are used to describe the same, similar or corresponding parts in the several views of FIGS. 1-4. Other definitions, explicit and implicit, may be included below.

As mentioned above, disconnectors are widely used in different sites when high voltage or high current electricity is being transmitted through power bus-bar. A disconnector is able to conduct power from the power bus-bars of power grid to bases for further use when the disconnector is closed to form an electrical connection with the power bus-bar. In addition, the power conduction is disconnected when the disconnector is opened.

FIG. 1 illustrates an environment in which a disconnector 100 is used to form an electrical connection with a bus-bar.

The bus-bar is usually supported by numerous towers and extends horizontally for a long distance but FIG. 1 merely shows a part of the bus-bar used for hanging the electrical contact 200.

As shown in FIG. 1, the disconnector 100 includes two pairs of conductive arms. The pairs of the conductive arms are hinged together and thus they are allowed to be pivoted relative to each other like a scissor. When the pairs of conductive arms are closed and brought to be in contact with the electrical contact 200, the conductive arms conduct the current from the electrical contact 200 to the bases, respectively. When the pairs of conductive arms are separated with the electrical contact 200, as shown in FIG. 1, such an electrical connection is disconnected. In general, disconnectors configured in a manner according to the present disclosure are able to conduct a current as high as several thousand amps. Therefore, the disconnectors are designed so as to endure and dissipate a lot of heat due to the high current.

The arms are usually not in contact with the electrical contact 200 directly because the arms are built by relatively less costly materials, which are less satisfying in terms of heat dissipation and conductivity so that the small-area contact between the electrical contact 200 and the arms may cause unwanted issues such as overheat. The component directly in contact with the electrical contact 200 can be referred to as finger contact, which is located on each of the arms. The principles and details of the finger contact will be explained below in reference to FIG. 2.

However, it is to be understood that although FIG. 1 shows exactly four conductive arms constituting two pairs, the number of pair(s) is not to be restricted as long as the conductive arms) can form a steady and robust connection with the electrical contact, and the current to be directed does not result in an overheat of the conductive arm(s). Other components or mechanisms can be used in place of the ones shown in FIG. 1 as long as the current can be directed from the electrical contact in a desired manner.

Figure 2:
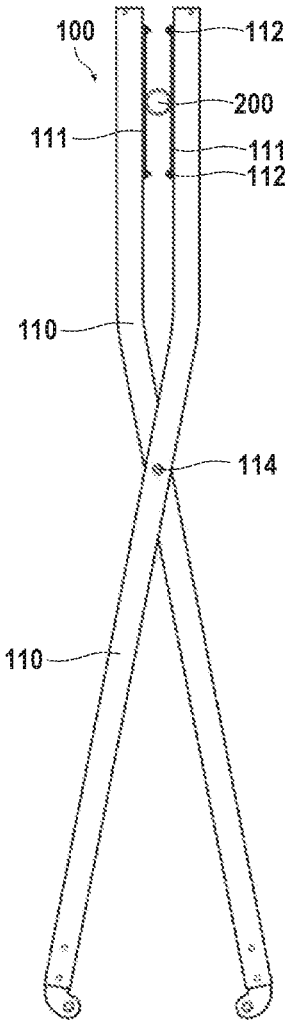
FIG. 2 illustrates a pair of conductive arms with an electrical contact clamped there between in accordance with one example embodiment.

FIG. 2 illustrates a pair of conductive arms 110 with an electrical contact 200 clamped there between in accordance with one embodiment of the present disclosure. The pair of conductive arms 110 may be constructed in an identical or similar shape, or in a different shape. For each pair, two conductive arms 110 are pivotally connected with each other via a hinge 114 so that the corresponding ends on the conductive arms 110 can be moved like a scissor. The electrical contact 200 can be held or clamped by the two conductive arms 110, such that an electrical current on the electrical contact 200 can be conducted through the entire conductive arm 110 to other components (not shown) at the bottom. In some embodiments, the conductive arms 110 can be made of any suitable conductive materials such as aluminum alloy, and their outer surfaces are made electrically conductive with or without additional coatings. The conductive arms 110 can be made hollow or solid depending on the requirements.

For the cost-effective considering, the materials used for forming the conductive arms 110 is usually chosen such as aluminum alloy which has good performance of electrical conductivity and mechanical strength but isn't very expensive. The conductive arms 110 are not directly in contact with the electrical contact 200 as the relatively small contact area may cause overheat. Additional finger contacts 111 made of materials with better conductivity are thus in need between the electrical contact 200 and the conductive arms 110.

In one embodiment, a finger contact 111 is provided on each of the conductive arms 110. The finger contact 111 can be fixed to the conductive arm 110 by two fasteners 112 at two opposite ends of the finger contact 111. For example, the finger contact 111 can be made of copper, which is an excellent conductor widely used as various contacts. The number of fasteners 112 is not necessarily two, but the middle portion of the finger contact 111 is normally free of fasteners because this gives ample span and tolerance for the coupling between the electrical contact 200 and the finger contact 111.

The finger contact 111 has an elastic portion (to be denoted by a numeral reference "133" in the descriptions below) between the two opposite ends. As such, in case that the finger contact 111 is installed or fastened onto the conductive arm 110, the elastic portion is deformed and in turn presses against the conductive arm 110. As a result, the finger contact 111 is fastened to the conductive arm 110 more closely. This will eliminate any loose contact between the finger contact 111 and the conductive arm 110, namely, the mechanical and electrical properties are thus improved. The elastic portion can be pre-shaped, which will be discussed in the following.

The outer surfaces of the finger contact 111 and the conductive arm 110 are made electrically conductive so that the contact between the finger contact 111 and the conductive arm 110 is able to form an electrically connection. However, for improved excellent performance of conductivity and anti-electrochemical corrosion, the outer surfaces of the finger contact 111 can be coated with silver, and some portions of the outer surfaces of the conductive arm 110 can be also coated with suitable paints for aesthetic or anticorrosion purposes.

Figure 3A:
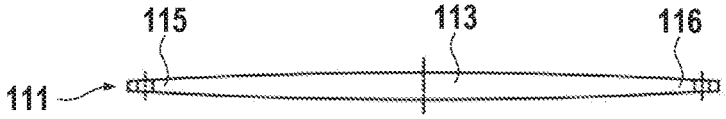
FIGS. 3*a* to 3*c* illustrate schematic diagrams of a process where the finger contact is fastened onto the conductive arm in accordance with one example embodiment.
Figure 3B:
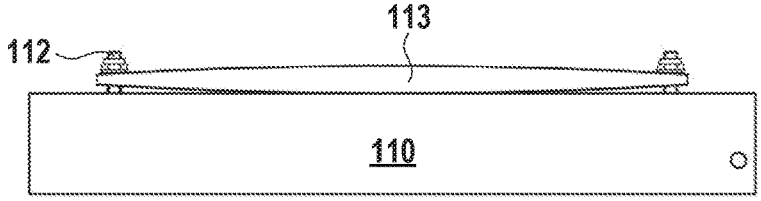
Figure 3C:
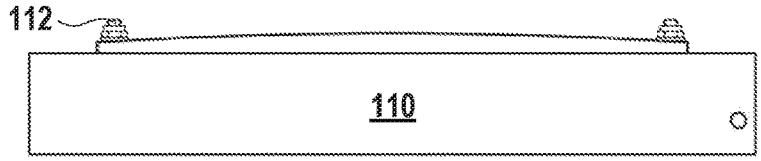

FIGS. 3*a* to 3*c* illustrate schematic diagrams of a process where the finger contact 111 is fastened onto the conductive arm 110. In this example, as shown in FIG. 3*a*, a finger contact 111 has two opposite ends 115, 116 and an elastic portion 113 between the two opposite ends 115, 116. The elastic portion 113 is larger in thickness than the two opposite ends 115, 116, and the thickness gradually decreases towards the two opposite ends 115, 116. In one example as shown in FIG. 3*a*, the thickness is larger in the middle portion than the thickness in the vicinity of the two ends 115, 116, so that the final product of the finger contact 111 appears as a spindle where the thickness gradually decreases when moving from the middle portion to the ends. The thicker portion act as the elastic portion 113 because when the finger contact 111 is mounted onto the conductive arm 110, the thicker portion is forced outwards in relation to the conductive arm 110. The finger contact 111 can be integrally formed by various known manufacturing methods such as die casting.

It is to be understood that although the finger contact 111 shown in FIG. 3*a* appears to have a much larger thickness, such a thickness is exaggerated for the sake of clarity. In practice, the middle portion may only have a slightly larger thickness than those at the ends, for example, by 5%, 10%, 20% or the like. The present disclosure does not mean to limit the extent to which the elastic portion 113 is thickened.

When the finger contact 111 is laid onto the conductive arm 110, as shown in FIG. 3*b*, it is first deposited onto two bolts. The finger contact 111 can be drilled with two holes at its opposite ends to fit the diameter of the bolt. Then, respective fasteners 112 in the form of a nut to be fixed (screwed) onto the bolts in a way that prevents rotating the fasteners 112 backwards.

After the fasteners 112 are fully screwed onto the bolts, the finger contact 111 are tightly fixed to the conductive arm 110 at both ends, as shown in FIG. 3*c*. Due to the elastic force provided by the elastic portion 113, the finger contact 111 and the conductive arm 110 are fastened in a way that almost any loose contact there between can be eliminated. Therefore, a relatively cost effective solution is provided to form a robust and firm connection between the finger contact 111 and the conductive arm 110 so that a maximum span of contact can be realized. As a result, the electrical conduction and thermal dissipation can be improved when the disconnector is used to conduct current from the electrical contact 200 to the conductive arm 110.

Figure 4A:
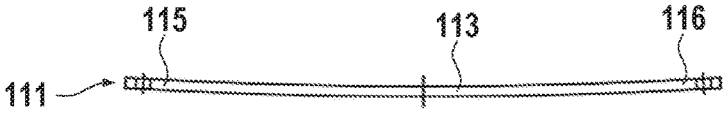
FIGS. 4*a* to 4*c* illustrate schematic diagrams of a process where the finger contact is fastened onto the conductive arm in accordance with another example embodiment.
Figure 4B:
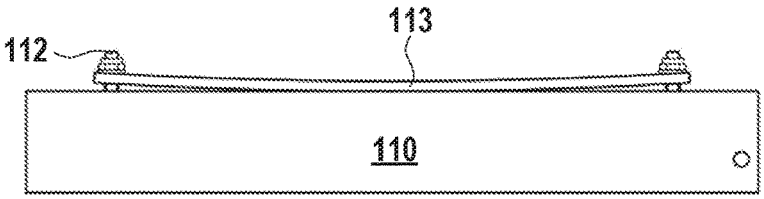
Figure 4C:
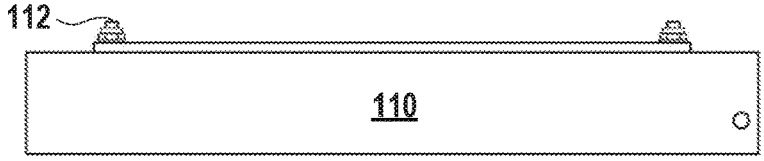

FIGS. 4*a* to 4*c* illustrate schematic diagrams of a process where the finger contact 111 is fastened onto the conductive arm 110. In this example, as shown in FIG. 4*a*, the finger contact 111 can be formed as an elongate bar made of solid copper. In one embodiment, the finger contact 111 is an arc bar. The arc bar may have an outer surface for pressing against the conductive arm 110 when the finger contact 111 is mounted to the conductive arm 110. The arc bar may also have an inner surface opposite to the outer surface. In this example, the outer surface is larger in radius than the inner surface so that the final product of the finger contact 111 appears as an arc with a proper curvature acting as the elastic portion 113. The finger contact 111 can be integrally formed by various known manufacturing methods such as die casting.

In another embodiment, a portion between two opposite ends 115, 116 of the finger contact 111 can be pre-shaped, or more specifically pre-bended, in order to form the elastic portion 113. The pre-bended finger contact 111 is stable in shape with a proper curvature, for example. In such a case, a convex side for pressing against the conductive arm 110 and an opposite concave side are provided on the pre-bended portion.

The finger contact 111 can be flattened by applying forces onto its opposite ends 115 and 116. Moreover, due to the elasticity, the flattened finger contact 111 can return to its pre-deformed shape once the applied forces are retrieved. As such, the finger contact 111 is elastic rather than plastic to the extent that the finger contact 111 is flattened. For example, the finger contact 111 in a free state may exhibit an adequately curved profile. The curvature is not to be limited by the present disclosure, and any appropriate curvature can be formed beforehand for the sake of a desired elasticity.

When the finger contact 111 is laid onto the conductive arm 110, as shown in FIG. 4*b*, it is first deposited onto two bolts. The finger contact 111 can be drilled with two holes at its opposite ends to fit the diameter of the bolt. Then, respective fasteners 112 in the form of a nut to be fixed (screwed) onto the bolts in a way that prevents rotating the fasteners 112 backwards.

In one example, the finger contact 111 can be pressed against the conductive arm 110 by a clamp before screwing the nuts to the bolts. After the fasteners 112 are fully screwed onto the bolts, the finger contact 111 are tightly fixed to the conductive arm 110 at both ends, as shown in FIG. 4*c*. Due to the elastic force provided by the elastic portion 113, the finger contact 111 and the conductive arm 110 are fastened in a way that almost any loose contact there between can be eliminated. Therefore, a relatively cost effective solution is provided to form a robust and firm connection between the finger contact 111 and the conductive arm 110 so that a maximum span of contact can be realized. As a result, the electrical conduction and thermal dissipation can be improved when the disconnector is used to conduct current from the electrical contact 200 to the conductive arm 110.

It is to be understood that the nut as shown in FIGS. 3*b*, 3*c*, 4*b* and 4*c* is merely one example of various fasteners. Other kinds of fasteners can be used as long as the finger contact 111 with an elastic portion 113 is able to be fixed to the conductive arm 110 in a reliable and robust manner. Although the finger contact 111 as shown is elongate, any other suitable shape of the finger contact 111 can be adopted if the electrical contact 200, usually in a form of a wire, can be steadily clamped by the finger contacts 111 on a pair of the conductive arms 110.

Figure 5:
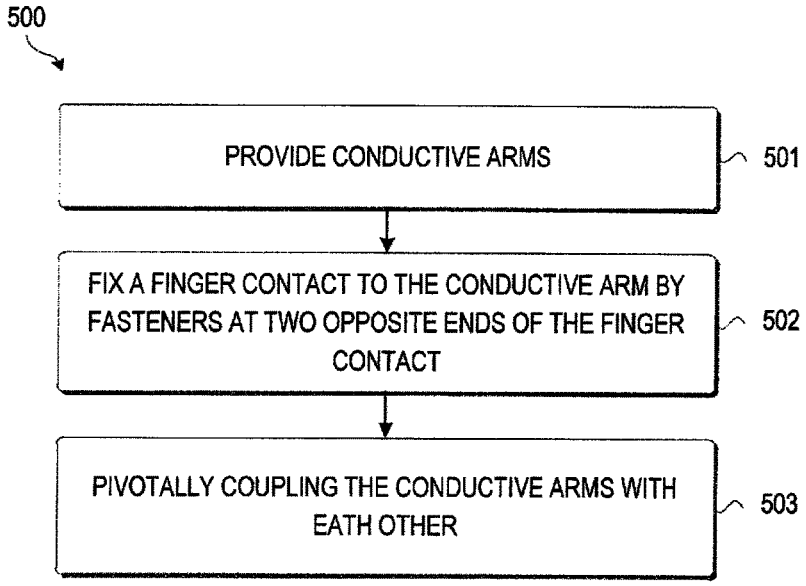
FIG. 5 illustrates a process flow of manufacturing a disconnector in accordance with one example embodiment.
Figure 6:
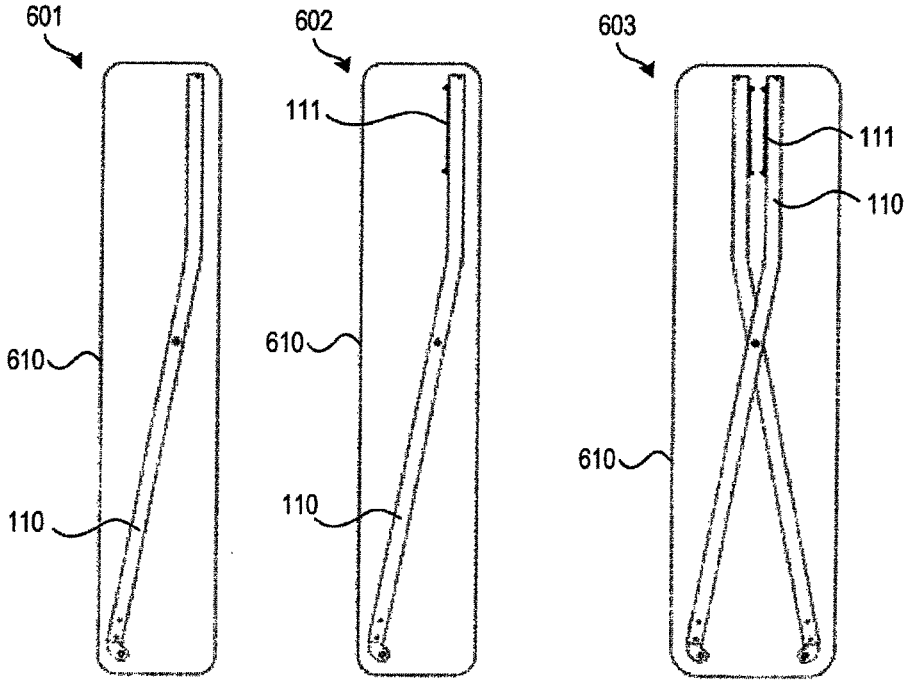
FIG. 6 illustrates different statuses corresponding to the process flow of FIG. 5.

FIG. 5 illustrates a process flow 500 of manufacturing a disconnector in accordance with the present disclosure. FIG. 6 illustrates different statuses 601 to 603 corresponding to the process flow of FIG. 5. At 501, a conductive arm is provided. As shown in FIG. 6, a conductive arm 110 is provided on an operation base 610.

At 502, a finger contact 111 is fixed to the conductive arm 110 by fasteners at two opposite ends of the finger contact 111. The finger contact 111 has two opposite ends and an elastic portion between the two opposite ends. The elastic portion is used to press against the conductive arm in case that the finger contact is fixed onto the conductive arm. A status 602 of the conductive arm 110 mounted with the finger contact 111 on the operation base 610 (i.e., after the step 502) can be shown in FIG. 6.

At 503, a pair of the conductive arms 110 is pivotally coupled with each other. The finger contact 111 is configured that, in response to the pair of conductive arms 110 being pivoted toward each other and clamping an electrical contact hanged at a bus-bar above the disconnector, the pair of conductive arms 110 are electrically coupled with the electrical contact via the respective finger contacts. A status 603 of the pair of the conductive arm 110 being pivotally coupled with each other on the operation base 610 (i.e., after the step 503) can be shown in FIG. 6.

In one embodiment, the method 500 may further include providing the elastic portion larger in thickness than the two opposite ends, the thickness gradually decreasing towards the two opposite ends.

In one embodiment, the method 500 may further include providing the finger contacts as arc bars having an outer surface for pressing against the conductive arm and an inner surface, the outer surface being larger in radius than the inner surface.

In one embodiment, the method 500 may further include providing the finger contacts as elongated bars, in which the elastic portion is a pre-bended portion on the respective finger contact.

In one embodiment, the method 500 may further include providing a convex side for pressing against the conductive arm and a concave side opposite to the convex side on the pre-bended portion.

In one embodiment, the method 500 may further include providing nuts as the fastener, wherein the each of the nuts is adapted to be fixed onto a bolt on the respective conductive arm.

While operations are depicted in a particular order in the above descriptions, this should not be understood as requiring that such operations be performed in the particular order shown or in sequential order, or that all illustrated operations be performed, to achieve desirable results. In certain circumstances, multitasking and parallel processing may be advantageous. Likewise, while several details are contained in the above discussions, these should not be construed as limitations on the scope of the subject matter described herein, but rather as descriptions of features that may be specific to particular embodiments. Certain features that are described in the context of separate embodiments may also be implemented in combination in a single embodiment. On the other hand, various features that are described in the context of a single embodiment may also be implemented in multiple embodiments separately or in any suitable sub-combination.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A disconnector comprising:

conductive arms pivotally coupled with each other; and finger contacts having two opposite ends and an elastic portion between the two opposite ends, each of the finger contacts being fixed to a respective conductive arm by fasteners at the two opposite ends such that the elastic portion presses against the conductive arm, wherein in response to the conductive arms being pivoted toward each other and clamping an electrical contact hanged at a bus-bar above the disconnector, the conductive arms are electrically coupled with the electrical contact via a respective finger contact of the finger contacts; and wherein the elastic portion is larger in thickness than the two opposite ends, and the thickness gradually decreases towards the two opposite ends.

2. The disconnector according to claim 1, wherein the finger contacts are arc bars having an outer surface for pressing against the conductive arm and an inner surface located opposite to the outer surface, the outer surface being larger in radius than the inner surface.

3. The disconnector according to claim 1, wherein the finger contacts are elongated bars, and the elastic portion is a pre-bended portion on the respective finger contact.

4. The disconnector according to claim 3, wherein the pre-bended portion has a convex side for pressing against the conductive arm and a concave side opposite to the convex side.

5. The disconnector according to claim 1, wherein the fasteners are nuts adapted to be fixed onto bolts on the conductive arms.

6. The disconnector according to claim 1, wherein the conductive arms are made of aluminum alloy, and outer surfaces of the conductive arms are electrically conductive.

7. The disconnector according to claim 1, wherein each of the finger contacts is made of copper.

8. The disconnector according to claim 7, wherein a layer of silver is coated on each of the finger contacts.

9. The disconnector according to claim 1, wherein the fasteners are nuts adapted to be fixed onto bolts on the conductive arms;

wherein the conductive arms are made of aluminum alloy, and outer surfaces of the conductive arms are electrically conductive;

wherein each of the finger contacts is made of copper.

10. A method of manufacturing a disconnector, comprising:

providing conductive arms;

for each of the conductive arms, fixing a finger contact having two opposite ends and an elastic portion between the two opposite ends to a respective conductive arm by fasteners at the two opposite ends, such that the elastic portion presses against the conductive arm;

pivotally coupling the conductive arms with each other, such that in response to the conductive arms being pivoted toward each other and clamping an electrical contact hanged at a bus-bar above the disconnector, the conductive arms are electrically coupled with the electrical contact via a respective finger contact of the finger contacts; and providing the elastic portion larger in thickness than the two opposite ends, the thickness gradually decreasing towards the two opposite ends.

11. The method according to claim 10, further comprising:

providing the finger contacts as arc bars having an outer surface for pressing against the conductive arm and an inner surface located opposite to the outer surface, the outer surface being larger in radius than the inner surface.

12. The method according to claim 10, further comprising:

providing the finger contacts as elongated bars, in which the elastic portion is a pre-bended portion on the respective finger contact.

13. The method according to claim 12, further comprising:

providing a convex side for pressing against the conductive arm and a concave side opposite to the convex side on the pre-bended portion.

14. The method according to claim 10, further comprising:

providing nuts as the fastener, wherein the each of the nuts is adapted to be fixed onto a bolt on the respective conductive arm.

15. The method according to claim 10, further comprising:

providing nuts as the fastener, wherein the each of the nuts is adapted to be fixed onto a bolt on the respective conductive arm;

wherein each of the finger contacts is made of copper;

wherein a layer of silver is coated on each of the finger contacts.

* * * * *